US005785494A

United States Patent [19]

Vild et al.

[11] Patent Number: 5,785,494

[45] Date of Patent: Jul. 28, 1998

[54] MOLTEN METAL IMPELLER

[75] Inventors: Chris T. Vild, Cleveland Heights; Mark A. Bright, Maple Heights, both of Ohio

[73] Assignee: Metaullics Systems Co., L.P., Solon, Ohio

[21] Appl. No.: 842,004

[22] Filed: Apr. 23, 1997

Related U.S. Application Data

[60] Provisional application No. 60/018,216 Apr. 23, 1996.

[51] Int. Cl.[6] ..... F04D 7/06

[52] U.S. Cl. ..... 415/200; 415/206; 415/217.1; 416/181; 416/182; 416/241 B

[58] Field of Search ..... 415/200, 217.1, 415/206, 90; 416/179, 181, 182, 185, 186 R, 223 B, 241 B; 266/235, 239

[56] References Cited

U.S. PATENT DOCUMENTS

| | | | |
|---|---|---|---|
| 1,865,918 | 7/1932 | Junkers | 416/179 |
| 2,948,524 | 8/1960 | Sweeney et al. | 415/200 |
| 5,088,893 | 2/1992 | Gilbert et al. | 415/200 |
| 5,180,280 | 1/1993 | Honda | 416/223 B |
| 5,330,328 | 7/1994 | Cooper | 415/200 |

FOREIGN PATENT DOCUMENTS

| | | | |
|---|---|---|---|
| 574079 | 12/1945 | United Kingdom | 415/206 |
| 789674 | 1/1958 | United Kingdom | 416/179 |

*Primary Examiner*—Christopher Verdier

*Attorney, Agent, or Firm*—Fay, Sharpe, Beall, Fagan, Minnich & McKee

[57] ABSTRACT

An impeller for a molten metal pump having a cylindrical body comprised of a refractory material. The cylindrical body includes generally coplanar top and bottom surfaces. A central bore is provided in the top surface to provide a point for mating with a shaft. A plurality of circumferentially spaced passages extend from the top surface to a side wall of the impeller, each of the passages being separate and preferably having an inlet opening which is equal to or less than the corresponding outlet opening in size.

17 Claims, 3 Drawing Sheets

MOLTEN METAL IMPELLER

This application claims the benefit of U.S. Provisional patent application Ser. No. 60/018,216 filed Apr. 23, 1996.

BACKGROUND OF THE INVENTION

This invention relates to molten metal pumps. More particularly, this invention relates to an impeller suited for use in a molten metal pump. The impeller of the present invention is particularly well suited to be used in molten aluminum and molten zinc pumps. In fact, throughout the specification, numerous references will be made to the use of the impeller in molten aluminum pumps, and certain prior art molten aluminum pumps will be discussed. However, it should be realized that the invention can be used in any pump utilized in the refining of molten metals.

In the processing of molten metals, it is often necessary to move molten metal from one place to another. When it is desired to remove molten metal from a vessel, a so called transfer pump is used. When it is desired to circulate molten metal within a vessel, a so called circulation pump is used. When it is desired to purify molten metal disposed within a vessel, a so called gas injection pump is used. In each of these types of pumps, a rotatable impeller is disposed within a pumping chamber in a vessel containing the molten metal. Rotation of the impeller within the pumping chamber draws in molten metal and expels it in a direction governed by the design of the pumping chamber.

In each of the above referenced pumps, the pumping chamber is formed in a base member which is suspended within the molten metal by means of posts. The impeller is supported for rotation in the base member by means of a rotatable shaft connected to a drive motor located atop a platform which is also supported by the posts.

Molten metal pump designers are generally concerned with efficiency, effectiveness and longevity. For a given diameter impeller, efficiency is defined by the work output of the pump divided by the work input of the motor. An equally important quality of effectiveness is defined as molten metal flow per impeller revolutions per minute.

A particularly troublesome aspect of molten metal pump operation is the degradation of the impeller. Moreover, to operate in a high temperature, reactive molten metal environment, a refractory or graphite material is used from which to construct the impeller. However, these materials are also prone to degradation when exposed to particles entrained in the molten metal. More specifically, the molten metal may include pieces of the refractory lining of the molten metal furnace, undesirables from the metal feed stock and occlusions which develop via chemical reaction, all of which can cause damage to an impeller if passed therethrough.

With regard to earlier impeller designs, U.S. Pat. No. 4,940,384, herein incorporated by reference, displays a molten metal pump with a cup-like impeller having vanes and lateral openings for moving molten metal. Although the impeller of this design adequately pumps molten metal, it is prone to clogging when particles are drawn into the pump. More specifically, because the inlet to the impeller makes up the entire top surface area adjacent the centrally disposed hub, large particles can enter the impeller but cannot exit through the smaller radial openings. Accordingly, a risk for catastrophic failure of the pump results if a large particle is jammed against the volute or the pumping chamber. In addition, small particles can slowly clog the radial openings and degrade the performance of the impeller by reducing the volume of molten metal that can be transferred.

In U.S. Pat. No. 5,586,863, a significantly improved molten metal impeller design is provided. More specifically, an impeller comprised of a spherical base, a central hub and radially directed vanes is described. This design achieves a significant advantage by providing a smaller inlet area than outlet area, which more readily passes particles without jamming and/or clogging. However, this design is slightly disadvantaged in that molten metal flow between adjacent vanes is difficult to control.

Accordingly, an impeller having low clogging characteristics, yet also providing high efficiencies would be highly desirable in the art. The current invention achieves these objectives. Moreover, the current invention achieves a number of advantages in directional forced metal flow. For example, the impeller of the current pump is not prone to clogging as in many of the prior impellers. Accordingly, catastrophic failure is much less likely to occur and the effectiveness of operation does not degrade rapidly over time. The design also achieves high strength by increasing the load area via a contiguous top surface. Furthermore, the impeller design can be prepared with relatively simple manufacturing processes. Therefore, the cost of production is low and accommodates a wide selection of materials, such as graphite or ceramics.

SUMMARY OF THE INVENTION

It is the primary object of this invention to provide a new and improved molten metal pump. It is a further object of this invention to provide a new and improved impeller for use in a molten metal pump.

To achieve the foregoing objects and in accordance with the purpose of the invention as embodied and broadly described herein, the molten metal pump of this invention comprises a motor having an elongated drive shaft with first and second ends. The first end mates with the motor and the second end is attached to an impeller disposed in a pumping chamber. The impeller is comprised of a cylindrical body of a refractory material and includes generally coplanar top and bottom surfaces, with a first central bore in the top surface that mates with the shaft. A plurality of circumferentially spaced passages extend from the top surface to a sidewall of the impeller. Each of the passages provides a separate duct from an inlet opening at the top surface to an outlet opening at the sidewall.

In addition, preferably each inlet opening has a cross-sectional area which is the same as or less than it's corresponding outlet opening. In a further preferred embodiment, the impeller is comprised of graphite. In a particularly preferred form, the impeller includes at least two passages, and more preferably six passages. Preferably, the impeller is provided with a bearing ring surrounding the edge of the bottom surface. In a further preferred embodiment, the top surface of the impeller is formed of a ceramic material and the body of the impeller is graphite.

DETAILED DESCRIPTION OF THE INVENTION

Reference will now be made in detail to the present preferred embodiment of the invention, an example of which is illustrated in the accompanying drawings. While the invention will be described in connection with the preferred embodiment, it will be understood that it is not intended to limit the invention to that embodiment. On the contrary, it is intended to cover all alternatives, modifications and equivalents that may be included within the spirit and scope of the invention defined by the appended claims.

This invention is directed to a new and improved impeller for use in molten metal pumps. In particular, the impeller is utilized in molten metal pumps to create a forced directional flow of molten zinc or molten aluminum. U.S. Pat. Nos. 2,948,524; 5,078,572, 5,088,893; 5,330,328; 5,308,045 and 5,470,201, herein incorporated by reference, describe a variety of molten metal pumps and environments in which the present impeller could be used.

Figure 2:
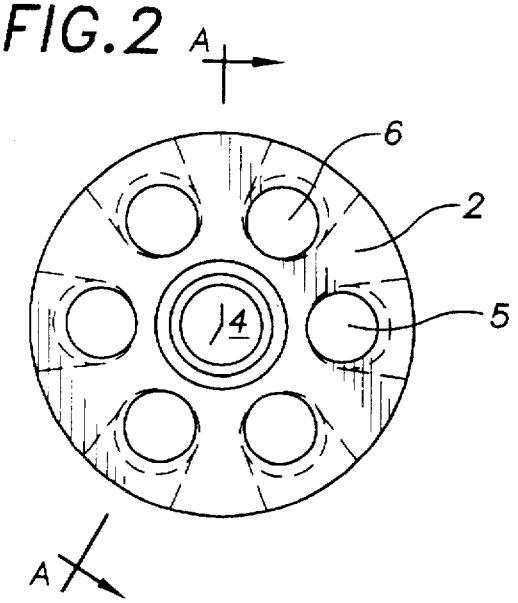
FIG. 2 is a top view of the inventive impeller, showing the passages in cross section.
Figure 1:
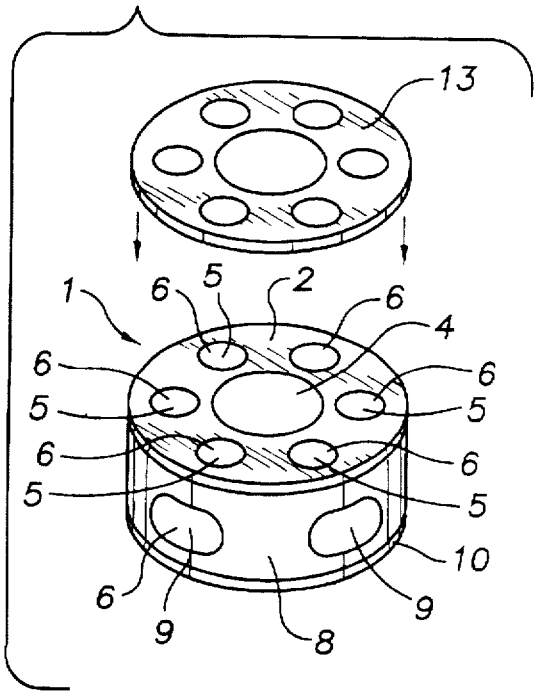
FIG. 1 is a perspective view of the inventive impeller.
Figure 2A:
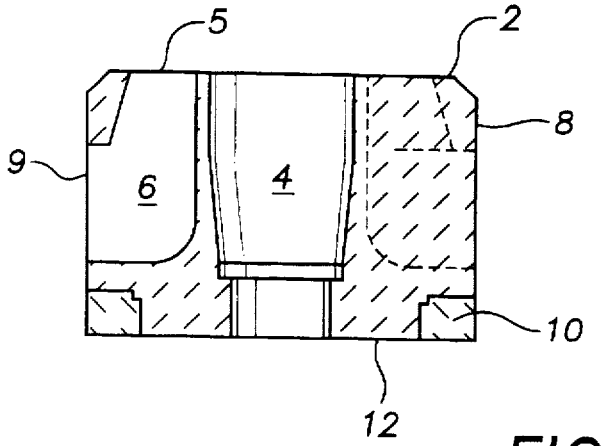
FIG. 2A is a cross sectional view taken along lines A—A in FIG. 2.

Referring now to FIGS. 1, 2 and 2A, the inventive impeller 1 is a generally cylindrical shaped body of graphite or ceramic and includes an upper face 2 having a recess 4 to accommodate a shaft. The upper face 2 also includes inlets 5 to passages 6 which extend downwardly from the upper face and outwardly through a sidewall 8, to an outlet 9. A bearing ring 10 of a ceramic, such as silicon carbide, is provided surrounding the outer edge of a lower face 12. FIG. 1 also shows an optional ceramic disc 13, which can be cemented to the top surface 2 of the impeller 1 to improve the wear characteristics of the device. With specific reference to FIGS. 2 and 2A, the passages 6 increase in diameter from the inlet 5 to the outlet 9. In this manner, any particle which can enter the impeller will also exit.

Figure 4:
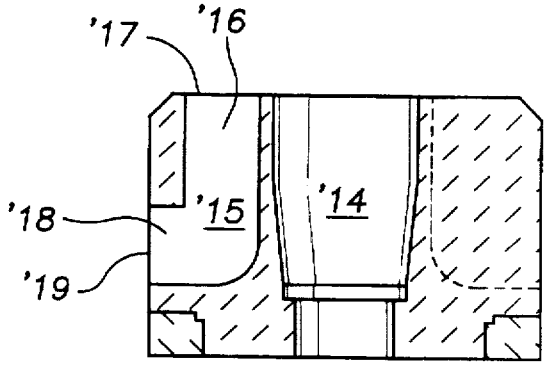
FIG. 4 is a cross-sectional view similar to that of FIGS. 2A, and 3A, of an alternative embodiment of the inventive impeller.
Figure 3:
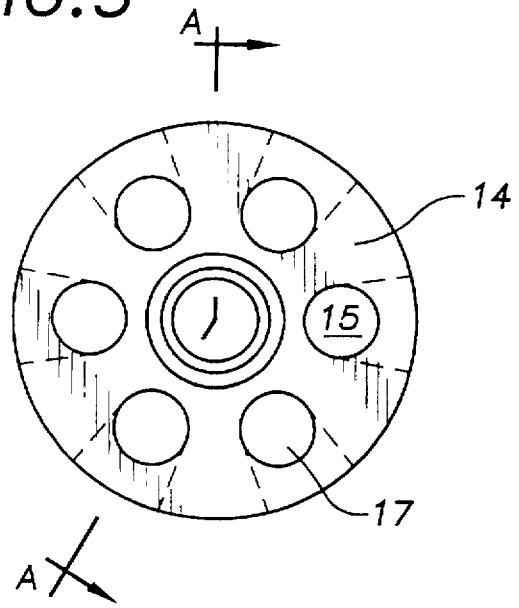
FIG. 3 is a top view of alternative embodiment of the inventive impeller.
Figure 3A:
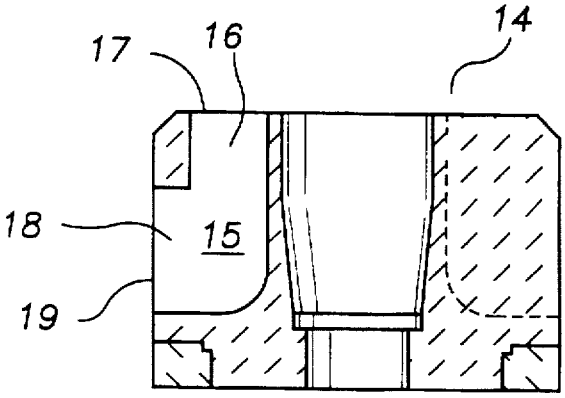
FIG. 3A is a cross sectional view taken along lines A—A in FIG. 3.

FIGS. 3, 3A, and 4 depict an alternative embodiment of the impeller. Particularly, in FIGS. 2 and 2A, the passages have an increasing diameter throughout their length. In contrast, the impeller 14 of FIGS. 3 and 3A includes passages 15 having a first diameter portion in a downward direction 16 and a second wider diameter portion 18 in an outward direction. Nonetheless, an inlet 17 has a smaller diameter than an outlet 19.

FIG. 4 shows an impeller '14 wherein an inlet '17 and an outlet '19 have equivalent cross-sectional areas. Furthermore, the cross-sectional area of passages '15 are substantially equivalent in both the vertical component '16 and the horizontal component '18. Nonetheless, absent any constriction of the flow path, the passages provide a "tunnel" which will accommodate the flow-through of any particle which can fit into the inlet.

Figure 5:
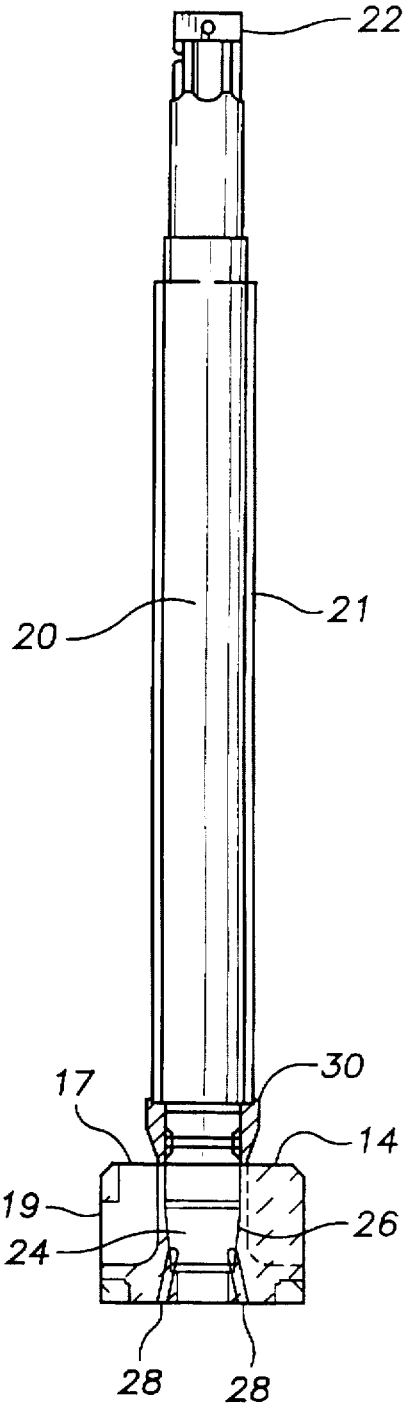
FIG. 5 is a side elevation view of the inventive impeller secured to a drive shaft, partially in cross section; and, FIG. 6 is an exploded view of a molten metal pump including the inventive impeller.

FIG. 5 is included to depict the inventive impeller 14 attached to a shaft 20. The shaft 20 is substantially encased in a protective sheath 21, and includes a first end 22 which mates with a drive motor (see FIG. 5). The second end includes a tapered portion 24 which mates with the tapered walls of a central bore 26 in the impeller 14. The shaft is secured in the bore 26 by cement (not shown) and several dowels 28. A bearing ring 30 is also positioned on the shaft—cemented in place—to provide a wear surface.

Figure 6:
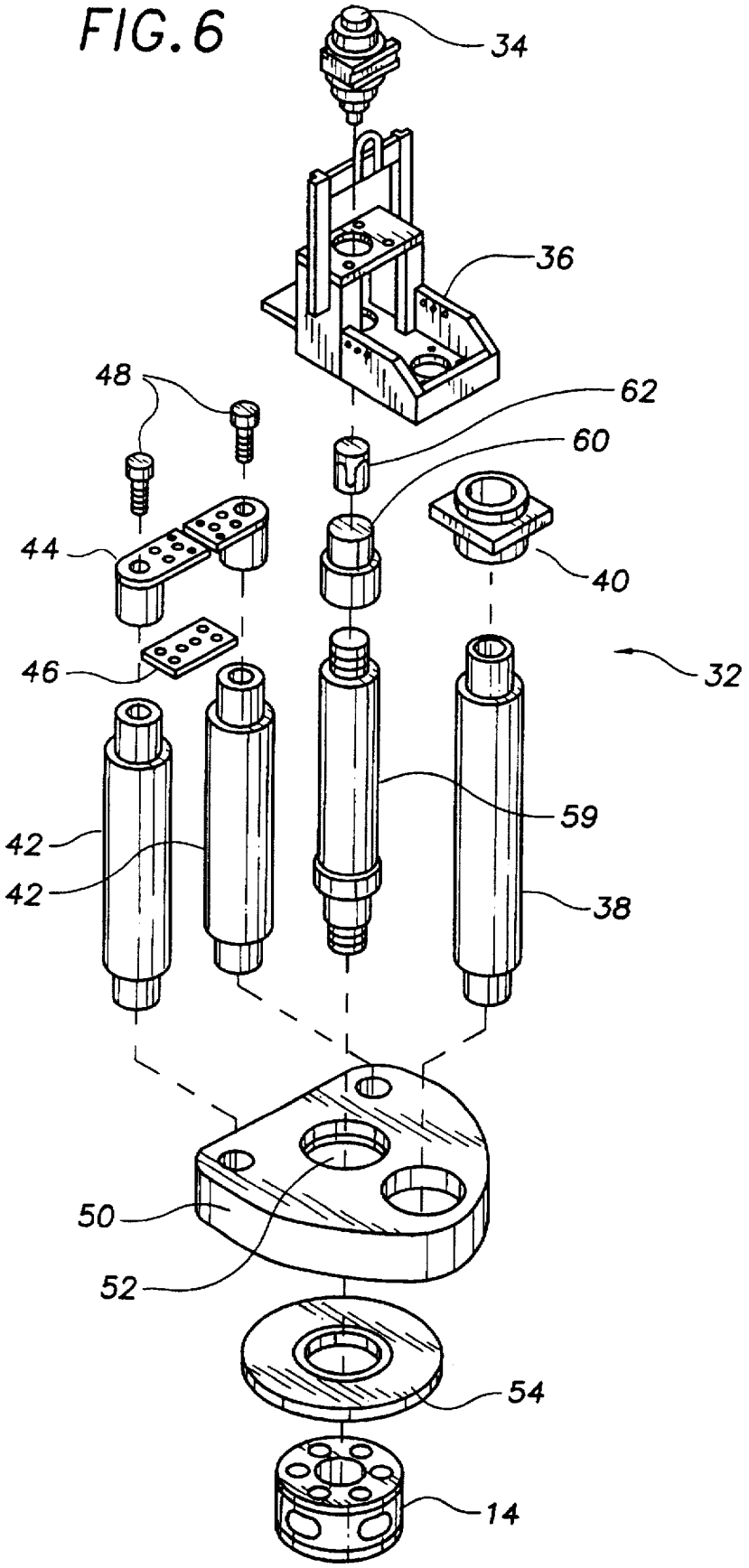

FIG. 6 depicts the arrangement of the impeller 14 in a molten metal pump 32. Particularly, a motor 34, is secured to a motor mount 36. A riser 38 (indicating this pump to be a transfer-style)through which molten metal is pumped is provided. The riser 38 is attached to the motor mount 36 via a riser socket 40. A pair of refractory posts 42 are secured by a corresponding pair of post sockets 44, a rear support plate 46 and bolts 48 to the motor mount 36. At a second end, each of the posts 42, and the riser 38, are cemented into a base 50. The base 50 includes a pumping chamber 52, in which the impeller 14 is disposed. The pumping chamber is constructed such that the impeller bearing ring 10 is adjacent the base bearing ring 54. The impeller is rotated within the pumping chamber via a shaft 59 secured to the motor by a threaded connection 60 pinned to a universal joint 62.

The novel impeller has a generally cylindrical shape and is formed of a refractory material such as graphite or a ceramic such as silicon carbide. The cylindrical piece includes a cavity in its upper face suitable to accommodate a shaft. The shaft, in turn, is joined to a motor to achieve rotation of the impeller. The periphery of the upper face is machined to include a plurality of passages which extend downwardly and outwardly from the upper face to the sides of the cylindrical impeller. In the preferred embodiment, six passages are formed and provide a large fluid volume area.

Importantly, the passages are formed such that they provide a "tunnel" at the upper face of the impeller which effectively provides entrainment of any particular particles entering the impeller and prevents lodging/jamming between the rotating impeller body and the pump casing. Moreover, any occlusions which are too large to enter the passage will be thrown clear of the pump by centrifugal force, preventing catastrophic failure of the pump. Furthermore, in the preferred embodiment of the impeller, any occlusions or scrap contained in the molten metal which is small enough to enter this dimension of the passage will of necessity be sized such that it can exit the impeller.

Thus, it is apparent that there has been provided, in accordance with this invention, a molten metal impeller and pump that fully satisfies the objects, aims and advantages set forth above. While the invention has been described in conjunction with specific embodiments thereof, it is evident that many alternatives, modifications, and variations will be apparent to those skilled in the art. In light of the foregoing description, accordingly, it is intended to embrace all such alternatives, modifications, and variations as fall within the spirit and broad scope of the impended claims.

We claim:

1. An impeller for a molten metal pump having a cylindrical body comprised of a refractory material, said cylindrical body including generally coplanar top and bottom surfaces and a substantially contiguous sidewall, a first central bore being provided in said top surface for mating with a shaft, a plurality of circumferentially spaced passages extending from said top surface to said sidewall of said impeller, each of said passages being separate and having an inlet opening in said top surface and an outlet opening in said sidewall.

2. The impeller of claim 1 being comprised of graphite.

3. The impeller of claim 1 having at least two passages.

4. The impeller of claim 1 wherein each said passage respectively includes an increasing cross sectional area from said respective inlet opening to said respective outlet opening.

5. The impeller of claim 1 wherein each said passage includes a downwardly depending section extending from said top surface and a horizontal section extending from said sidewall which intersects said respective downwardly depending portion.

6. The impeller of claim 5 wherein said respective horizontal section has a larger diameter than said respective downwardly depending section.

7. The impeller of claim 1 wherein each said passage respectively includes a consistent cross-sectional area from said respective inlet to said respective outlet.

8. The impeller of claim 1 wherein a bearing ring forms an outer edge of said bottom surface.

9. The impeller of claim 1 wherein said top surface is comprised of a ceramic material and the remainder of said cylindrical body is comprised of graphite.

10. The impeller of claim 1 including six passages.

11. The impeller of claim 1 wherein each said respective inlet opening provides a cross-sectional surface area which is equal to or less than a cross-sectional surface area of each said respective outlet opening.

12. A molten metal pump impeller comprising a cylindrical body of a refractory material, said cylindrical body having opposed generally circular top and bottom surfaces interconnected by a substantially contiguous sidewall, said top surface including a generally centrally located hub or bore and a plurality of radially disposed inlets, each said inlet forming a fluid communication with a respective passage in said body to a respective outlet positioned in said sidewall, and each said respective inlet having a cross-sectional area equal to or less than each said respective outlet.

13. The molten metal pump impeller of claim 12 being comprised of graphite.

14. The molten metal pump impeller of claim 12 including a bearing ring surrounding at least a portion of said cylindrical body.

15. A molten metal pump comprising:

(a) an elongated shaft having first and second ends;

(b) a means for rotating said shaft about an axis in communication with said first end of said shaft;

(c) an impeller disposed adjacent said second end of said shaft;

(d) a pumping chamber housing said impeller, said pumping chamber having an inlet opening through which molten metal can be drawn and a outlet opening through which molten metal can be discharged; and (e) said impeller comprised of a cylindrical body of a refractory material, said cylindrical body including generally coplanar top and bottom surfaces, a first central bore being provided in said top surface for mating with said elongated shaft, a plurality of circumferentially spaced passages extending from said top surface to a substantially contiguous sidewall of said impeller, each of said passages being separate and having an inlet at said top surface and an outlet at said side wall.

16. The pump of claim 15 being a transfer-type.

17. The pump of claim 15 being a gas-injection type.

* * * * *